United States Patent [19]

Barnert

[11] 3,934,564

[45] Jan. 27, 1976

[54] CONTROL VALVE FOR EXHAUST GAS RECYCLING APPARATUS

[75] Inventor: Konrad Barnert, Wolfsburg, Germany

[73] Assignee: Volkswagenwerk Aktiengesellschaft, Wolfsburg, Germany

[22] Filed: Dec. 28, 1973

[21] Appl. No.: 429,625

[30] Foreign Application Priority Data

Jan. 22, 1973 Germany ..... 2303007

[52] U.S. Cl. ..... 123/119 A; 251/208

[51] Int. Cl.[2] ..... F02M 25/06

[58] Field of Search ..... 123/119 A; 251/208

[56] References Cited

UNITED STATES PATENTS

| | | | |
|---|---|---|---|
| 1,191,700 | 7/1916 | Howes | 251/208 |
| 1,793,554 | 2/1931 | Moore | 123/119 A |
| 2,114,548 | 4/1938 | Stadlman | 123/119 A |
| 2,361,227 | 10/1944 | Mock | 251/208 |
| 2,722,927 | 11/1955 | Cornelius | 123/119 A |
| 3,127,071 | 3/1964 | Bingham | 251/208 |
| 3,646,764 | 3/1972 | Nakajima et al. | 123/119 A |
| 3,817,232 | 6/1974 | Nakajima et al. | 123/119 A |

*Primary Examiner*—Wendell E. Burns
*Assistant Examiner*—Sheldon Richter
*Attorney, Agent, or Firm*—Brumbaugh, Graves, Donohue & Raymond

[57] ABSTRACT

In apparatus associated with an internal combustion engine for recycling exhaust gas and including at least one device for converting an operating parameter of the engine into mechanical regulating movement, a valve controls the quantity of exhaust gas recycled. The valve includes a housing having an inlet and an outlet for the exhaust gas. At least one perforated member is disposed between the inlet and the outlet. A rotatable axis mounts the perforated member such that a hole in the member can be moved into and out of alignment with an opening in a portion of the housing to open and close the opening and control a flow of exhaust gas through the valve. The axle is coupled to the converting device of the recycling apparatus.

2 Claims, 4 Drawing Figures

Fig.1
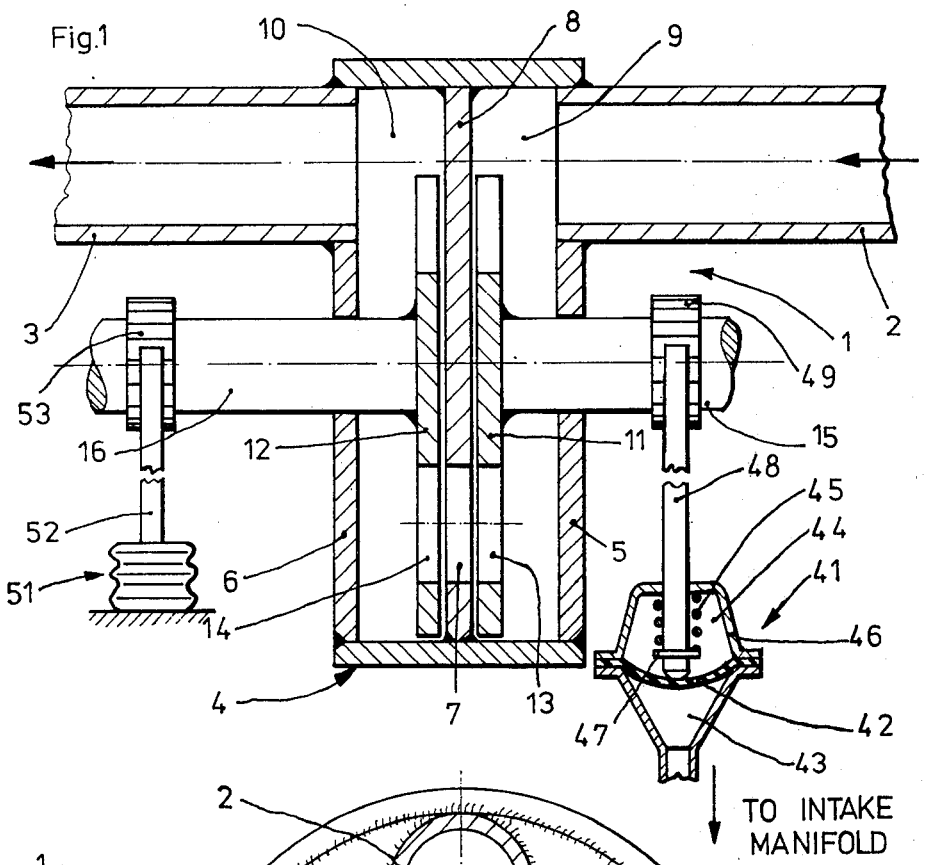
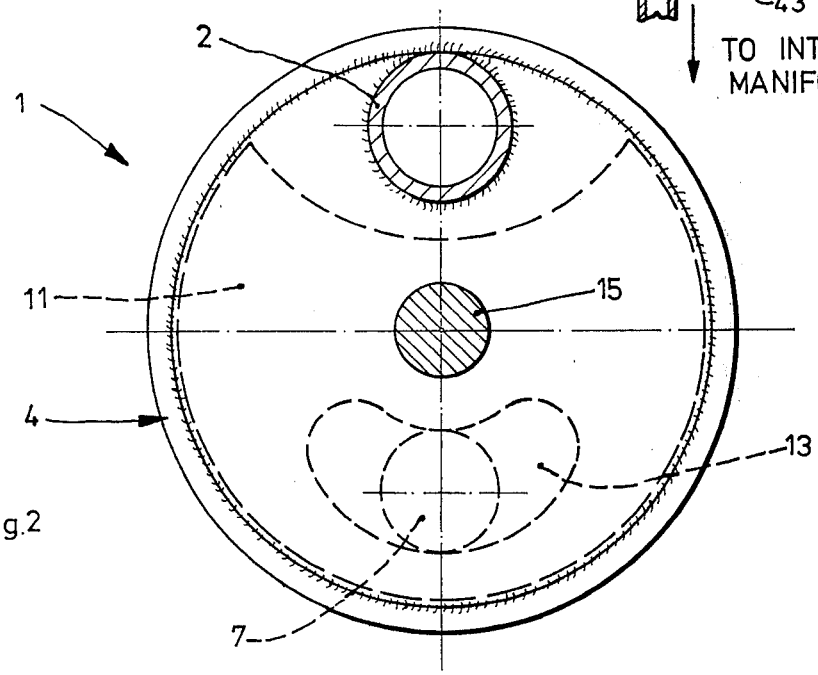
Fig.2

CONTROL VALVE FOR EXHAUST GAS RECYCLING APPARATUS

BACKGROUND OF THE INVENTION

To reduce the quantity of atmospheric pollutants in exhaust gases from internal combustion engines and to meet the increasingly stringent regulations regarding the content of such gases, various methods and associated apparatus have been developed to purify exhaust gases. One such method is to recycle a portion of the exhaust gas from an engine back through the engine. Particular apparatus used to practice the recycling method of emission control is described and discussed in paper No. 720123 published by the Society of Automotive Engineers, Inc. (SAE). The paper is entitled "Exhaust Recirculation and Spark Control — A Speed Governed and Vacuum Modulated System" and is authored by E. J. Martin and D. R. Vance.

Each version of the apparatus described in SAE paper No. 720123 includes a conduit extending from an engine exhaust line to a point in the engine air/fuel intake system. A valve in the conduit regulates the flow of exhaust gas from the exhaust line to the air/fuel intake system. The valve is operated in response to an operating parameter of the engine, such as the pressure in the engine intake manifold, by an actuator device that converts the operating parameter into mechanical regulating movement. In at least one embodiment of the apparatus, the regulating valve is also initially held shut, by the operation of a speed switch and a solenoid valve, until a minimum speed is attained by the vehicle driven by the engine. The regulating valves used are either flap type or poppet type valves. As is pointed out in the paper, flap or butterfly type valves, in particular, are difficult to construct and seal.

SUMMARY OF THE INVENTION

The present invention is directed to a regulating or control valve for use in exhaust gas recycling apparatus, such as described above, which includes at least one device for converting an operating parameter of an engine into mechanical regulating movement. The valve, according to the invention, comprises a housing having an inlet and an outlet for the exhaust gas. At least one perforated member is disposed between the inlet and the outlet. A rotatable axle mounts the perforated member such that a hole in the member can be moved into and out of alignment with an opening in a portion of the housing. Movement of the perforated member thus can close the opening or open it to any desired degree to control the flow of exhaust gas through the valve. The axle mounting the member is coupled to the converting device of the recycling apparatus. The hole in the perforated member may be configured, relative to the configuration of the opening in the portion of the housing, so as to ensure control in accordance with a particular characteristic curve for the engine.

The housing portion having the opening may be an end wall including either the inlet or the outlet, where the inlet or outlet is the opening. The housing portion may also be a partition disposed between the inlet and the outlet and dividing the housing into two chambers. If a partition is utilized, the valve is particularly suited to include at least two perforated members, at least one of which is located in each housing chamber. The members are mounted on different axles that are coupled to different devices for converting operating parameters of the engine into mechanical regulating movement. The holes in both plates may then be configured, relative to the configuration of the opening in the partition, so as to ensure control in accordance with a performance graph for the engine. As is well known, such a performance graph may be the dependence of the power or the medium cylinder pressure of the engine from intake manifold pressure and engine speed or from throttle position and engine speed or from the air quantity supplied to an engine with fuel injection and engine speed. On the other hand, the invention equipped with two or more plates may be used to control the recycled quantity of exhaust gas in dependence from operating parameters of the engine not defining a performance graph in its usual sense, for instance from throttle position and intake manifold pressure or from exhaust gas back-pressure and throttle position or from intake throttle position and oil temperature or from exhaust gas back-pressure and intake manifold pressure. The desired control can be determined during manufacture by appropriate selection of the dimensions of the hole in the perforated valve member both circumferentially and radially of the member. Thus the invention allows control of exhaust gas recycling in dependence from more than one parameter, the effects of these parameters on the control being independent from each other though only one valve is necessary.

As can be seen from the above description, the components of the valve, according to the invention, have uncomplicated configurations and minimal critical tolerances, thus making the valve as a whole relatively easy to produce. The construction of the valve also permits the use of uncomplicated mechanisms for rotating the mounting axle or axles to adjust the valve as quickly as may be required by the operating conditions of the engine. Cam plates acting on the axle or axles, for example, can be used to effect quick closing of the valve.

BRIEF DESCRIPTION OF THE DRAWINGS

For a better understanding of the invention, reference may be made to the following descriptions of two exemplary embodiments, taken in conjunction with the figures of the accompanying drawings, in which:

FIG. 1 is a sectional view of a valve according to the invention, installed in a line for recycling exhaust gas from an internal combustion engine;

FIG. 2 is a sectional view taken along view line 2—2 of FIG. 1;

DESCRIPTION OF THE EMBODIMENTS

Figure 3:
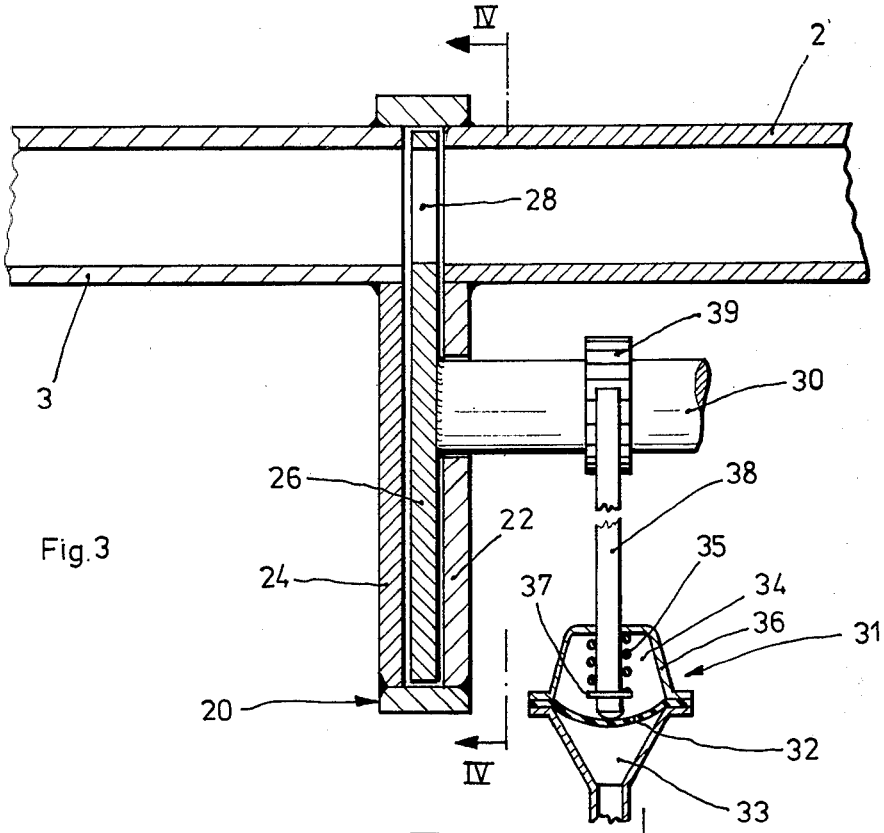
FIG. 3 is a sectional view of a second embodiment of a valve according to the invention, installed in a line for recycling exhaust gas from an internal combustion engine.

FIGS. 1 and 2 of the drawings illustrate a valve according to the invention, generally designated 1, installed in a line or conduit for recycling exhaust gas from an internal combustion engine (not shown). The part of the line extending from the exhaust system of the engine is designated 2 and the part of the line leading to the intake system of the engine is designated 3. The valve 1 includes a cylindrical valve housing 4 having end walls 5 and 6. Aligned openings in the end walls 5 and 6 adjacent corresponding edges thereof receive the ends of line parts 2 and 3, respectively, and thereby define a valve inlet and a valve outlet. A circular partition 8, provided with an opening 7 located adjacent an edge of the partition diametrically opposite the valve inlet and outlet, divides the housing 4 into two chambers 9 and 10.

Two perforated plates 11 and 12 are disposed within the valve housing 4 adjacent the partition 8 and generally parallel to the end walls 5 and 6 and the partition. The portions of the plates 11 and 12 adjacent the partition opening 7 are provided with holes, designated 13 and 14, respectively, and cutouts are provided in the edge portions of the plates nearer the inlet and the outlet. The perforated plate 11 is mounted in the chamber 9 on a rotatable axle 15 which passes through the end wall 5 of the valve housing 4. The plate 12 is similarly mounted in the chamber 10 on another rotatable axle 16 passing through the end wall 6 of the housing 4.

Outside the valve housing 4, the axles 15 and 16 are coupled to appropriate devices for converting operating parameters of the engine into mechanical regulating movement. The devices may be of any conventional type having pneumatic, hydraulic, electrical or mechanical drives, and may respond to any desired parameters, like the devices described in SAE paper No. 720123. In the embodiment of the invention illustrated in FIGS. 1 and 2, however, the axle 15 is coupled to a conversion device, generally designated 41, responsive to pressures in the intake manifold (not shown) for the engine. The axle 16 is coupled to device, generally designated 51, responsive to engine temperature.

The pressure responsive device 41, which is shown in reduced size for simplicity, includes a pair of chambers 43 and 44 separated by a flexible diaphragm 42. The chamber 43 is connected to the engine intake manifold and the pressure in the chamber follows the manifold pressure. The pressure in the chamber 44, on the other hand, is maintained at atmospheric pressure. One end of an operating rod 48 projects into the chamber 44 and is spring biased into constant contact with the diaphragm 42. The biasing spring 45 encircles the operating rod 48 and is held between an interior wall of the housing 46 for the device 41 and a collar 47 fixed on the rod adjacent its end contacting the diaphragm 42. The exposed end of the rod 48 is provided with gear teeth to define a rack that meshes with a pinion gear 49 carried by the shaft 15.

In operation, changes in intake manifold pressure flex the diaphragm 42. The operating rod 48 follows the flexing of the diaphragm 42 and the axial movement of the rod produces rotating movement of the shaft 15 and the plate 11. An increase in manifold pressure, for example, will cause the diaphragm to flex upwardly, as viewed in FIG. 1, and will result in clockwise rotation of the plate 11, as viewed in FIG. 2.

The temperature sensitive device 51 is coupled to the axle 16 by an operating rod 52 having a rack that engages a pinion gear 53 carried by the axle 16. The device 51 may have any conventional construction and may include, for example, an expansible bellows filled with a fluid that expands and contracts in response to temperature changes. The temperature sensitive device might alternatively include a temperature gauge producing an electrical output that is converted into movement of the operating rod.

In operation of the valve 1, the positions of the holes 13 and 14 in the perforated plates 11 and 12, respectively, relative to the opening 7 in the partition 8 control the cross-sectional flow area for and, hence, the quantity of recycled exhaust gas passing through the valve. The flow area thus may be either linearly or non-linearly related to the angles of rotation of the plates 11 and 12, depending upon the configurations of the holes 13 and 14 in the plates. As shown in FIG. 2, the hole 13 in the plate 11 is approximately kidney-shaped to give a particular non-linear relationship between the angle of rotation of the perforated plate 11 and the effective flow area provided by the opening 7 and the holes 13 and 14. Other shapes may be selected for the holes 13 and 14 according to the control relationship desired.

Since the effective cross-sectional flow area of the valve 1 is related to the angular position of the plates 11 and 12 determined by the operation of the conversion devices 41 and 51, the flow area is also related to the values of the operating parameters to which the conversion devices 41 and 51 are responsive. Appropriate configuration of the holes 13 and 14, therefore, results in the flow area of the valve 1 being controlled in accordance with a particular characteristic curve or family of characteristic curves defined by plotting values of flow area against values of one operating parameter. A family of curves results from the independent influence of the other operating parameter on the flow area of the valve.

Figure 4:
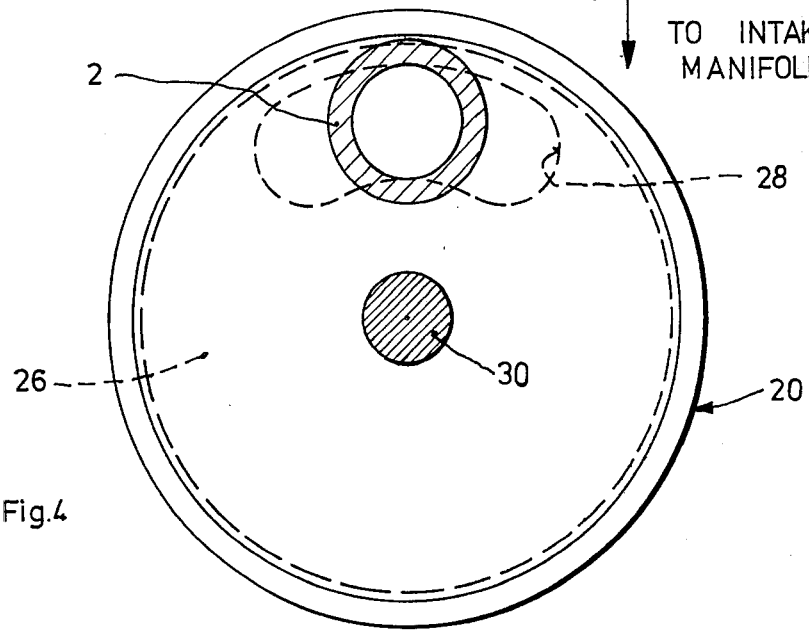
FIG. 4 is a sectional view takten along view line 4—4 of FIG. 3.

In another embodiment of the invention, as illustrated in FIGS. 3 and 4, the valve housing 20 includes end walls 22 and 24 that receive the parts 2 and 3, respectively, of the exhaust gas recycling line. Unlike the housing 4 of the embodiment of FIGS. 1 and 2, however, the valve housing 20 does not include a partition. Likewise, there is only a single circular perforated plate 26 mounted on a rotatable axle 30. A hole 28 formed in the plate 26 is positioned so that the hole can be moved into and out of alignment with the inlet and outlet openings in the housing end walls 22 and 24, respectively.

As in the embodiment of FIGS. 1 and 2, the axle 30 of FIGS. 3 and 4 is coupled to a pressure responsive device 31 for converting intake manifold pressure into mechanical regulating movement. The construction of the device 31 is identical to the construction of the device 41 of FIGS. 1 and 2 and corresponding elements are designated with reference numerals derived by subtracting ten from the reference numerals of FIGS. 1 and 2.

The operation of the valve of FIGS. 3 and 4 is similar to the operation of valve 1, except that only one operating parameter determines the valve operation. The valve may be provided with one or more additional plates coupled to different conversion devices, just as the valve 1 of FIGS. 1 and 2 may have additional plates and also additional partitions, if desired.

It will be understood that the above-described embodiments are merely exemplary and that those skilled in the art may make many variations and modifications without departing from the spirit and scope of the invention. All such modifications and variations are intended to be within the scope of the invention as defined in the appended claims.

I claim:

1. In apparatus for recycling exhaust gas and including two devices for converting operating parameters of an internal combustion engine into mechanical regulating movement, the improvement of a valve for controlling the quantity of exhaust gas recycled comprising a housing having an inlet and an outlet for the exhaust gas and a stationary partition disposed between the inlet and the outlet and dividing the housing into two chambers, said partition having an opening therethrough for the passage of exhaust gas; two perforated plate members, each disposed in one of said chambers between said partition and the inlet and the outlet, respectively; and two rotatable axles, each axle mounting a different one of said two perforated members such that a hole in the respective perforated member can be moved into and out of alignment with said opening in said partition thereby to open and close said opening and control a flow of exhaust gas through the valve, each of the axles being adapted for coupling to a different one of the converting devices of the recycling apparatus.

2. The improvement of claim 1, wherein holes in both perforated members are configured relative to the configuration of the opening in the partition so as to ensure control in accordance with a family of characteristic curves for the engine.

* * * * *